US007416678B2

(12) United States Patent
Aratani

(10) Patent No.: US 7,416,678 B2
(45) Date of Patent: Aug. 26, 2008

(54) PROCESSING AGENTS FOR SYNTHETIC FIBERS

(75) Inventor: Satoshi Aratani, Aichi (JP)

(73) Assignee: Takemoto Yushi Kabushiki Kaisha, Aichi (JP)

( * ) Notice: Subject to any disclaimer, the term of this patent is extended or adjusted under 35 U.S.C. 154(b) by 0 days.

(21) Appl. No.: 12/026,669

(22) Filed: Feb. 6, 2008

(65) Prior Publication Data

US 2008/0135797 A1 Jun. 12, 2008

Related U.S. Application Data

(62) Division of application No. 11/190,081, filed on Jul. 25, 2005, now Pat. No. 7,351,350.

(30) Foreign Application Priority Data

Aug. 3, 2004 (JP) ..... 2004-226874
Jun. 10, 2005 (JP) ..... 2005-170406

(51) Int. Cl.
*D06M 13/148* (2006.01)

(52) U.S. Cl. ..... 252/8.61; 252/8.81; 252/8.84; 252/68; 508/110; 8/115.54; 8/115.56; 8/115.6; 8/115.51; 427/412; 516/198

(58) Field of Classification Search ..... 252/8.61, 252/8.81, 8.84, 68; 508/110; 8/115.51, 115.54, 8/115.56, 115.6; 427/412; 516/198
See application file for complete search history.

(56) References Cited

U.S. PATENT DOCUMENTS

| | | | |
|---|---|---|---|
| 2,935,426 | A | 5/1960 | Spence et al. |
| 2003/0050722 | A1 | 3/2003 | Murakami et al. |
| 2005/0288191 | A1 | 12/2005 | Lawrence et al. |

FOREIGN PATENT DOCUMENTS

| | | |
|---|---|---|
| EP | 0900875 | 3/1999 |
| EP | 0399377 | 2/2008 |
| JP | 2001098257 | 10/2001 |
| JP | 2002-256130 | * 11/2002 |

OTHER PUBLICATIONS

Schwartz Joel, "The Importance of Low Dynamic Surface Tension in Waterborne Coating", JCT. Journal of Coating Technology, Sep. 1992, vol. 64, No. 812, XP-000881184, pp. 65-74.

* cited by examiner

*Primary Examiner*—Lorna M. Douyon
*Assistant Examiner*—Tri V Nguyen
(74) *Attorney, Agent, or Firm*—Weaver Austin Villeneuva & Sampson LLP

(57) ABSTRACT

A processing agent for synthetic fibers contains a lubricant, a functional improvement agent and an emulsifier, each containing a specified kinds of components by a specified amount and also by a specified amount and also by specified total amount so as to have improved characteristics of preventing occurrence of fluffs, yard breaking and uneven dyeing when applied to synthetic fibers at a specified rate.

2 Claims, No Drawings

PROCESSING AGENTS FOR SYNTHETIC FIBERS

This is a divisional of application Ser. No. 11/190,081 filed Jul. 25, 2005, now U.S. Pat No. 7,351,350.

BACKGROUND OF THE INVENTION

This invention relates to agents for the processing of synthetic fibers and methods of processing synthetic fibers.

The production speed of synthetic fibers is increasing rapidly in recent years. At the same time, there is a tendency to increase the production of new kinds of synthetic fibers such as low denier synthetic fibers, high multifilament synthetic fibers and modified cross-section synthetic fibers. If synthetic fibers of such new types are produced at a higher speed, their friction increases with the yarn passing, guides, rollers and heater. This causes an increase in the friction-charged electrostatic potential, resulting in low cohesion and unwanted tension variations of synthetic fibers, and the problems of fluffs and yarn breaking tend to occur. The present invention relates to agents for and methods of processing synthetic fibers capable of sufficiently preventing the occurrence of fluffs and yarn breaking as well as dyeing specks even when synthetic fibers of the aforementioned new kinds are produced at an increased production rate.

Examples of prior art processing agent for synthetic fibers for preventing the occurrence of fluffs and yarn breaking at the time of their high rate of production include (1) processing agents for synthetic fibers containing polyether compounds with molecular weight of 1000-20000, having dialkylamine with random or block addition of alkaline oxide with 2-4 carbon atoms (such as disclosed in Japanese Patent Publication Tokkai 6-228885); (2) processing agents for synthetic fibers containing branched-chain polypropylene glycol having 4 or more branched chains (such as disclosed in Japanese Patent Publication Tokkai 10-273876); (3) processing agents for synthetic fibers containing a polyether lubricant having 10-50 weight % of polyether block of number average molecular weight of 1000-10000 with block copolymerization of ethylene oxide and propylene oxide at weight ratio of 80/20-20/80 (such as disclosed in Japanese Patent Publication Tokkai 2001-146683); and (4) processing agents for synthetic fibers containing polyoxyalkylene glycol with number average molecular weight of 5000-7000 with copolymerization of ethylene oxide and propylene oxide at weight ratio of 40/60-20/80, monocarboxylic acid with 8-14 carbon atoms and alkyl amine salt with 6-14 carbon atoms or quaternary ammonium salt (such as disclosed in Japanese Patent Publication Tokkai 10-245729).

These prior art processing agents are not sufficiently capable of preventing the occurrence of fluffs, yarn breaking and dyeing specks when synthetic fibers are produced at a fast rate and in particular when synthetic fibers of the aforementioned new kinds are produced at a fast rate.

SUMMARY OF THE INVENTION

It is therefore an object of this invention to provide a processing agent and a process method capable of sufficiently prevent the occurrence of fluffs, yarn breaking and dyeing specks even when new kinds of synthetic fibers such as low denier synthetic fibers, high multifilament fibers and modified cross-section synthetic fibers are produced at a fast rate The present invention is based on the discovery by the present inventor, as a result of his studies in view of the object described above, that a processing agent containing hydroxy compound of a specified kind at least as a part of functional improvement agent at a specified rate should be applied to the synthetic fibers.

DETAILED DESCRIPTION OF THE INVENTION

The invention firstly relates to a processing agent for synthetic fibers characterized as containing a lubricant and a functional improvement agent and containing hydroxy compound as described below in an amount of 1-30 weight % at least as a part of the functional improvement agent. The invention secondly relates to a processing method for synthetic fibers characterized as comprising the step of applying a processing agent of this invention to synthetic fibers so as to be 0.1-3 weight % with respect to the synthetic fibers. In the above, hydroxy compound is one or more selected from the group consisting of compounds shown by Formula 1 and the group consisting of compounds shown by Formula 2 where Formula 1 is:

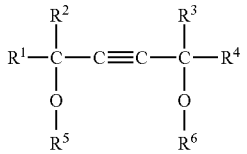

and Formula 2 is:

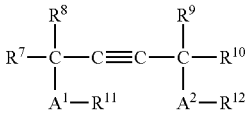

where $R^1$, $R^2$, $R^3$ and $R^4$ are each hydrogen atom or aliphatic hydrocarbon group with 1-12 carbon atoms (only two or less of them being hydrogen atom at the same time); $R^7$, $R^8$, $R^9$ and $R^{10}$ are each hydrogen atom or aliphatic hydrocarbon group with 1-12 carbon atoms (only two or less of them being hydrogen atom at the same time); $R^5$, $R^6$, $R^{11}$ and $R^{12}$ are each hydrogen atom, methyl group or acyl group with 1-3 carbon atoms; and $A^1$ and $A^2$ are each residual group obtainable by removing hydrogen atoms from all hydroxyl groups of (poly) alkyleneglycol having (poly)oxyalkylene group formed with a total of 1-30 oxyalkylene units with 2-4 carbon atoms.

Processing agents for synthetic fibers according to this invention (hereinafter referred to simply as processing agents of this invention) will be described first.

Processing agents of this invention are characterized as containing a lubricant and a functional improvement agent and containing hydroxy compound of a specified kind at least as a part of the functional improvement agent.

What is herein referred to as hydroxy compound of a specified kind is one or more selected from the group consisting of compounds shown by Formula 1 and the group consisting of compounds shown by Formula 2.

Regarding Formula 1, $R^1$, $R^2$, $R^3$ and $R^4$ are each hydrogen atom or aliphatic hydrocarbon group with 1-12 carbon atoms but only two or less of them may be both hydrogen atom. Thus, there are (1) examples where two of them are each aliphatic hydrocarbon group with 1-12 carbon atoms, the remaining two being each hydrogen atom; (2) examples where three of them are each aliphatic hydrocarbon group with 1-12 carbon atoms, the remaining one being hydrogen atom; and (3) examples where each of them is aliphatic hydrocarbon group with 1-12 carbon atoms. Among these examples, the examples in (1) are preferred. Examples of aliphatic hydrocarbon group with 1-12 carbon atoms in (1)-(3) include methyl group, ethyl group, butyl group, hexyl group, heptyl group, octal group, only group, decal group, unduly group, codicil group, isopropyl group, t-butyl group, isobutyl group, 2-methylpentyl group, 2-ethyl-hexyl group, 2-propel-heptyl group, 2-butyl-octal group, vinyl group, allyl group, hexane group and 10-unevenly group. Among these, aliphatic hydrocarbon groups with 1-6 carbon atoms are preferable and those for which the total number of carbon atoms for $R^1$-$R^4$ is 2-14 are particularly preferable. $R^5$ and $R^6$ are each (1) hydrogen atom, (2) methyl group or (3) acyl group with 1-3 carbon atoms such as formal group, acetyl group or propyonyl group. Among these, however, hydrogen atom is preferred.

The hydroxy compounds shown by Formula 1 themselves can be synthesized by a conventional method such as disclosed in Japanese Patent Publication Tokkai 2002-356451.

Regarding compounds shown by Formula 2, $R^7$-$R^{10}$ are the same as described above regarding $R^1$-$R^4$, and $R^{11}$ and $R^{12}$ are the same as described above regarding $R^5$ and $R^6$. $A^1$ and $A^2$ are each residual group obtainable by removing hydrogen atoms from all hydroxyl groups of (poly)alkyleneglycol having (poly)oxyalkylene group formed with a total of 1-30 oxyalkylene units with 2-4 carbon atoms. Examples of what $A^1$ and $A^2$ may each be include (1) residual groups obtainable by removing hydrogen atoms from all hydroxyl groups of alkyleneglycol having oxyalkylene unit formed with one oxyalkylene unit with 2-4 carbon atoms and (2) residual groups obtainable by removing hydrogen atoms from all hydroxyl groups of polyalkyleneglycol having polyoxyalkylene group formed with a total of 2-30 oxyalkylene units with 2-4 carbon atoms, and examples of oxyalkylene unit with 2-4 carbon atoms forming such polyoxyalkylene group include oxethylene unit, ox propylene unit and oxybutylene unit. Among these, residual group obtainable by removing hydrogen atoms from all hydroxyl groups of ethylene glycol, residual group obtainable by removing hydrogen atoms from all hydroxyl groups of propylene glycol and residual group obtainable by removing hydrogen atoms from all hydroxyl groups of polyalkyleneglycol having polyoxyalkylene group formed with a total of 2-12 ox ethylene units and ox propylene units are preferable. If the polyalkylene group is formed with two or more different oxyalkylene units, their connection may be random connection, block connection or random-block connection.

The hydroxy compounds shown by Formula 2, as explained above, themselves can be synthesized by a conventional method such as disclosed in Japanese Patent Publication Tokkai 3-163038.

Processing agents of this invention are characterized as containing a lubricant and a functional improvement agent and containing one or more of hydroxy compounds selected from the group of compounds shown by Formula 1 and the group of compounds shown by Formula 2 as described above in an amount of 1-30 weight % at least as a part of the functional improvement agent but those containing such hydroxy compounds in an amount of 2-25 weight % are preferable and those containing such hydroxy compounds in an amount of 5-20 weight % are even more preferable.

Processing agents of this invention may contain functional improvement agents other than the hydroxy compounds shown by Formula 1 and Formula 2. Examples of such other functional improvement agent include those conventionally known kinds such as (1) antistatic agents including anionic surfactants such as organic sulfuric acid salts and organic aliphatic acid salts, cationic surfactants such as laurel trim ethyl ammonium sulfate, and impolitic surfactants such as octal diethyl ammonioacetate; (2) oiliness improvement agents such as organic phosphoric acid salts and aliphatic acid salts; (3) penetration improvement agents such as polyether modified silicone having polydimethyl siloxane chain with average molecular weight of 1500-3000 as main chain and polyoxyalkylene chain with average molecular weight of 700-5000 as side chain and surfactant having perfluoroalkyl group; (4) cohesion improvement agents such as polyether polyesters; (5) extreme-pressure additives such as organic titanium compounds and organic phosphor compounds; (6) antioxidants such as phenol antioxidants, phosphate antioxidants and throatier antioxidants; and (7) antirust agents.

When a processing agent of this invention contains such other functional improvement agents, their content should preferably be 0.2-15 weight % and more preferably 1-12 weight %.

Processing agents of this invention contain a lubricant and a functional improvement agent as explained above. Examples of such lubricant include conventionally known kinds such as (1) polyether compounds; (2) aliphatic ester compounds; (3) aromatic ester compounds; (4) (poly)ether ester compounds; (5) mineral oils; and (6) silicone oils.

Examples of aforementioned polyether compound include polyether monopoly, polyether idol and polyether triol, all having polyoxyalkylene group in the molecule. Among these, however, polyether compounds with average molecular weight of 700-10000 are preferred and polyether compounds with average molecular weight of 700-10000 with monohydric-trihydric hydroxy compound with 1-18 carbon atoms having block or random attachment of alkylene oxide with 2-4 carbon atoms are particularly preferable.

Examples of aforementioned aliphatic ester compound include (1) ester compounds obtainable by esterification of aliphatic monohydric alcohol and aliphatic monocarboxylic acid such as butyl stearate, octyl stearate, oleyl stearate, oleyl oleate and isopentacosanyl isostearate; (2) ester compounds obtainable by esterification of aliphatic polyhydric alcohol and aliphatic monocarboxylic acid such as 1,6-hexanediol didecanoate and trimethylol propane monooleate monolaurate; and (3) ester compounds obtainable by esterification of aliphatic monohydric alcohol and aliphatic polycarboxylic acid such as dilauryl adipate and dioleyl azelate. Among these, however, aliphatic ester compounds with 17-60 carbon atoms are preferable and aliphatic ester compounds with 17-60 carbon atoms obtainable by esterification of aliphatic monohydric alcohol and aliphatic monocarboxylic acid or aliphatic polyhydric alcohol and aliphatic monocarboxylic acid are particularly preferable.

Examples of aforementioned aromatic ester compound include (1) ester compounds obtainable by esterification of aromatic alcohol and aliphatic monocarboxylic acid such as benzyl stearate and benzyl laureate; and (2) ester compounds obtainable by esterification of aliphatic monohydric alcohol and aromatic carboxylic acid such as diisostearyl isophthalate and trioctyl trimellitate. Among these, however, ester compounds obtainable by esterification of aliphatic monohydric alcohol and aromatic carboxylic acid are preferable.

Examples of aforementioned (poly)etherester compound include (1) (poly)etherester compounds obtainable by esterification of (poly)ether compound obtainable by adding alkylene oxide with 2-4 carbon atoms to monohydric-trihydric aliphatic alcohol with 4-26 carbon atoms and aliphatic carboxylic acid with 4-26 carbon atoms; (2) (poly)etherester compounds obtainable by esterification of (poly)ether compound obtainable by adding alkylene oxide with 2-4 carbon atoms to monohydric-trihydric aromatic alcohol and aliphatic carboxylic acid with 4-26 carbon atoms; and (3) (poly)ether-ester compounds obtainable by esterification of (poly)ether compound obtainable by adding alkylene oxide with 2-4 carbon atoms to aliphatic alcohol with 4-26 carbon atoms and aromatic carboxylic acid.

Examples of aforementioned mineral oil include mineral oils of various kinds having different viscosity values. Among these, however, those with viscosity $1\times10^{-6}$-$1.3\times10^{-1}$ $m^2/s$ at 30° C. are preferable and those with viscosity $1\times10^{-6}$-$5\times10$ $m^2/s$ are even more preferable. Examples of such preferable mineral oil include fluid paraffin oil.

Examples of aforementioned silicone oil include silicone oils of various kinds having different viscosity values. Among these, however, linear polyorganosiloxane with viscosity $1\times10^{-3}$-1 $m^2/s$ at 30° C. is preferable. Examples of such linear polyorganosiloxane include linear polydimethylsiloxane without substituent and linear polydimethylsiloxane with substituent, all with viscosity $1\times10^{-3}$-1 $m^2/s$ at 30° C. Examples of substituent in these cases include ethyl group, phenyl group, fluoropropyl group, aminopropyl group, carboxyoctyl group, polyoxyethylene oxypropyl group and ω-methoxy polyethoxypolypropoxy propyl group. Among these, linear polydimethylsiloxane without substituent is preferable.

Among processing agents of this invention, those containing a lubricant as described above in an amount of 50-90 weight % and a functional improvement agent as described above in an amount of 1-30 weight % are preferable. Those further containing a hydroxy compound shown by Formula 1 or Formula 2 as described above in an amount of 1-30 weight % as the functional improvement agent are even more preferable.

Processing agents of this invention may further contain an emulsifier. An emulsifier of a known kind may be used. Examples of emulsifier of a known kind that may be used for the purpose of this invention include (1) nonionic surfactants having polyoxyalkylene group in the molecule such as polyoxyalkylene alkylethers, polyoxyalkylene alkylphenylethers, polyoxyalkylene alkylesters, alkylene oxide adducts of castor oil and polyoxyalkylene alkylaminoethers; (2) partial esters of polyhydric alcohol type nonionic surfactants such as sorbitan monolaurate, sorbitan trioleate, glycerol monolaurate and diglycerol dilaurate; and (3) partial esters of polyhydric alcohol type nonionic surfactants such as alkylene oxide adducts of partial esters of trihydric-hexahydric alcohol and aliphatic acid and partial or complete esters of alkylene oxide adduct of trihydric-hexahydric alcohol and aliphatic acid. Among these, however, polyoxyalkylenealkylethers having polyoxyalkylene group with 3-10 oxyethylene units and alkyl group with 8-18 carbon atoms in the molecule are preferable.

If processing agents of this invention contain an emulsifier as described above, it is preferable that such an emulsifier be contained in an amount of 2-30 weight %.

Among the processing agents of this invention containing an emulsifier, those containing a lubricant in an amount of 50-90 weight %, a functional improvement agent in an amount of 1-30 weight % and an emulsifier in an amount of 2-30 weight % (with a total of 100 weight %) are preferable. Those containing a hydroxy compound shown by Formula 1 or Formula 2 as described above in an amount of 3-25 weight % at least as a part of this functional improvement agent are even more preferable.

Next, the method according to this invention for processing synthetic fibers (hereinafter referred to simply as the method of this invention) is explained. The method of this invention is a method of applying a processing agent of this invention as described above at a rate of 0.1-3 weight % and more preferably 0.3-1.2 weight % of the synthetic fibers to be processed. The fabrication step during which a processing agent of this invention is to be applied to the synthetic fibers may be the spinning step or the step during which spinning and drawing are carried out simultaneously. Examples of the method of causing a processing agent of this invention to be attached to the synthetic fibers include the roller oiling method, the guide oiling method using a measuring pump, the emersion oiling method and the spray oiling method. The form in which a processing agent of this invention may be applied to synthetic fibers may be as a neat, as an organic solution or as an aqueous solution but the form as an aqueous solution is preferable. When an aqueous solution of a processing agent of this invention is applied, it is preferable to apply the solution at a rate of 0.1-3 weight % and more preferably 0.3-1.2 weight % as the processing agent with respect to the synthetic fiber.

Examples of synthetic fibers that may be processed by a method of this invention include (1) polyester fibers such as polyethylene terephthalate, polypropylene terephthalate and polylactic ester fibers; (2) polyamide fibers such as nylon 6 and nylon 66; (3) polyacryl fibers such as polyacrylic and modacrylic fibers; (4) polyolefin fibers such as polyethylene and polypropylene fibers and polyurethane fibers. The present invention is particularly effective, however, when applied to polyester fibers and polyamide fibers.

The invention is described next by way of test examples but it goes without saying that these examples are not intended to limit the scope of the invention. In what follows, "part" will mean "weight part" and "%" will mean "weight %" unless otherwise specified.

Part 1 (Preparation of Hydroxy Compounds)

Preparation of Hydroxy Compound (A-1)

Potassium hydroxide powder (purity 95%) 47.5 g and naphthen solvent (range of boiling point 210-230° C., specific weight 0.79) 400 g were placed inside a 1-liter autoclave and methylethyl ketone 50 g was further added after acetylene was introduced to the gauge pressure of 0.02 MPa. A reaction mixture was obtained after temperature was kept at 25° C. for 2 hours. This reaction mixture 500 g was transferred into a separation funnel and after it was washed with water to remove the potassium hydroxide, an organic phase was separated. After hydrochloric acid with concentration of 0.1 mol/L was added to this organic phase to neutralize the remaining potassium hydroxide, an organic phase 456 g containing 3,6-dimethyl-4-octine-3,6-diol was separated. This organic phase 456 g was taken inside a separation funnel, dimethyl sulfoxide 90 g was added, and it was left stationary after shaken. The lower layer 151 g formed by layer separation was collected, the naphthen solvent 363 g was added, and it was left stationary after shaken. The lower layer 140 g formed by layer separation was collected and distilled at a reduced pressure to obtain 3,6-dimethyl-4-octyne-3,6-diol as hydroxy compound (A-1).

Preparation of Hydroxy Compounds (A-2)-(A-12) and (a-1)

Hydroxy compounds (A-2)-(A-12) and (a-1) were prepared similarly as hydroxy compound (A-1) explained above.

Preparation of Hydroxy Compound (A-15)

Hydroxy compound (A-1) as described above 170 g (1 mole) and boron trifluoride diethyl ether 5 g were placed inside an autoclave and after the interior of the autoclave was replaced with nitrogen gas, a mixture of ethylene oxide 352 g (8 moles) and propylene oxide 464 g (8 moles) was pressured in under a pressured and heated condition at 60-70° C. for a reaction. A reaction product was obtained after an hour of ageing reaction. This reaction product was analyzed and found to be hydroxy compound (A-15) according to Formula 2 wherein $R^7$ and $R^{10}$ are each methyl group, $R^8$ and $R^9$ are each ethyl group, $R^{11}$ and $R^{12}$ are each hydrogen atom, and $A^1$ and $A^2$ are each residual group obtainable by removing hydrogen atoms from all hydroxyl groups of polyalkyleneglycol having polyoxyalkylene group formed with a total of 8 oxyethylene units and oxypropylene units.

Preparation of Hydroxy Compounds (A-16)-(A-20) and (a-2)

Hydroxy compounds (A-16)-(A-20) and (a-2) were prepared similarly as hydroxy compound (A-15) explained above.

Preparation of Hydroxy Compound (A-21)

Hydroxy compound 694 g (1 mole) obtained by adding 10 moles of ethylene oxide to 1 mole of 2,2,7,7-tetramethyl-3,6-diethyl-4-octine-3,6-diol and 48% aqueous solution of potassium hydroxide 14.5 g were placed inside an autoclave and dehydrated with stirring at 70-100° C. under a reduced pressure condition. After an etherifecation reaction was carried out by maintaining the reaction temperature at 100-120° C. and pressuring in methyl chloride 106 g (2.1 moles) until the lowering of pressure inside the autoclave became unnoticeable, a reaction product 765 g was obtained by filtering away the potassium chloride obtained as by-product. This reaction product was analyzed and found to be hydroxy compound (A-21) according to Formula 2 wherein $R^7$ and $R^{10}$ are each ethyl group, $R^8$ and $R^9$ are each t-butyl group, $R^{11}$ and $R^{12}$ are each methyl group, and $A^1$ and $A^2$ are each residual group obtainable by removing hydrogen atoms from all hydroxyl groups of polyalkyleneglycol having polyoxyethylene group formed with a total of 5 oxyethylene units.

Preparation of Hydroxy Compounds (A-14) and (a-3)

Hydroxy compounds (A-14) and (a-3) were prepared similarly as hydroxy compound (A-21) explained above.

Preparation of Hydroxy Compound (A-22)

Hydroxy compound 1420 g (1 mole) obtained by adding 8 moles of ethylene oxide and 14 moles of propylene oxide to 1 mole of 2,9-dimethyl-4,7-diethyl-5-decyne-4,7-diol, glacial acetic acid 144 g (2.4 moles) and concentrated sulfuric acid 12 g were placed inside a flask for an esterification reaction with stirring by maintaining the reaction temperature at 100-110° C. and dehydrating under a reduced pressure condition. After the reaction was completed, it was cooled and the concentrated sulfuric acid and the non-reacted acetic acid were neutralized with 48% potassium hydroxide 70 g and the generated water was distilled away under a reduced pressure condition. A reaction product 1420 g was obtained by filtering away organic salts obtained as by-products. This reaction product was analyzed and found to be hydroxy compound (A-22) according to Formula 2 wherein $R^7$ and $R^{10}$ are each ethyl group, $R^8$ and $R^9$ are each isobutyl group, $R^{11}$ and $R^{12}$ are each acetyl group, and $A^1$ and $A^2$ are each residual group obtainable by removing hydrogen atoms from all hydroxyl groups of polyalkyleneglycol having polyoxyalkylene group formed with a total of 11 oxyethylene units and oxypropylene units.

Preparation of Hydroxy Compound (A-13)

Hydroxy compound (A-13) was prepared similarly as hydroxy compound (A-21) explained above.

Details of all these hydroxy compounds obtained above are shown below, those corresponding to Formula 1 being shown in Table 1 and those corresponding to Formula 2 being shown in Table 2.

TABLE 1

| | $R^1$ | $R^4$ | $R^2$ | $R^3$ | *1 | $R^5$ | $R^6$ |
|---|---|---|---|---|---|---|---|
| A-1 | Methyl group | Methyl group | Ethyl group | Ethyl group | 6 | Hydrogen atom | Hydrogen atom |
| A-2 | Hydrogen atom | Hydrogen atom | Methyl group | Methyl group | 2 | Hydrogen atom | Hydrogen atom |
| A-3 | Ethyl group | Ethyl group | Ethyl group | Ethyl group | 8 | Hydrogen atom | Hydrogen atom |
| A-4 | Methyl group | Methyl group | n-propyl group | n-propyl group | 8 | Hydrogen atom | Hydrogen atom |
| A-5 | Methyl group | Methyl group | Isopropyl group | Isopropyl group | 8 | Hydrogen atom | Hydrogen atom |
| A-6 | Methyl group | Methyl group | n-butyl group | n-butyl group | 10 | Hydrogen atom | Hydrogen atom |
| A-7 | Methyl group | Methyl group | Isobutyl group | Isobutyl group | 10 | Hydrogen atom | Hydrogen atom |
| A-8 | Hydrogen atom | Hydrogen atom | n-pentyl group | n-pentyl group | 10 | Hydrogen atom | Hydrogen atom |
| A-9 | Hydrogen atom | Hydrogen atom | n-hexyl group | n-hexyl group | 12 | Hydrogen atom | Hydrogen atom |
| A-10 | Methyl group | Methyl group | t-butyl group | t-butyl group | 12 | Hydrogen atom | Hydrogen atom |
| A-11 | Methyl group | Methyl group | Isopentyl group | Isopentyl group | 12 | Hydrogen atom | Hydrogen atom |
| A-12 | Lauryl group | Lauryl group | Isobutyl group | Isobutyl group | 32 | Hydrogen atom | Hydrogen atom |
| A-13 | Ethyl group | Ethyl group | Isopentyl group | Isopentyl group | 14 | Acetyl group | Acetyl group |
| A-14 | Ethyl group | Ethyl group | Isopentyl group | Isopentyl group | 14 | Methyl group | Methyl group |
| a-1 | Methyl group | Methyl group | Octa-decenyl group | Octa-decenyl group | 38 | Hydrogen atom | Hydrogen atom |

In Table 1:

*1: Sum of carbon atom numbers of $R^1$-$R^4$

TABLE 2

| | $R^7$ | $R^{10}$ | $R^8$ | $R^9$ | *2 | $A^1$ *3 | $A^2$ *3 | $R^{11}$ | $R^{12}$ |
|---|---|---|---|---|---|---|---|---|---|
| A-15 | MG | MG | EG | EG | 6 | EO/4 PO/4 | EO/4 PO/4 | HA | HA |
| A-16 | MG | MG | IPG | IPG | 8 | EO/2 PO/2 | EO/2 PO/2 | HA | HA |
| A-17 | MG | MG | IBG | IBG | 10 | EO/7 | EO/7 | HA | HA |
| A-18 | MG | MG | IPNG | IPNG | 12 | EO/15 PO/5 | EO/15 PO/5 | HA | HA |
| A-19 | MG | MG | EG | EG | 6 | EO/1 | EO/1 | HA | HA |
| A-20 | HA | HA | EG | EG | 4 | EO/25 | EO/25 | HA | HA |
| A-21 | EG | EG | tBG | tBG | 12 | EO/5 | EO/5 | MG | MG |
| A-22 | EG | EG | IBG | IBG | 12 | EO/4 BO/7 | EO/4 BO/7 | AG | AG |
| a-2 | MG | MG | IPG | IPG | 6 | EO/20 PO/20 | EO/20 PO/20 | HA | HA |
| a-3 | EG | EG | IPG | IPG | 6 | EO/5 | EO/5 | BG | BG |

In Table 2:
*2: Sum of carbon atom numbers of $R^7$-$R^{10}$
*3: Kind/Repetition number of oxyalkylene units
EO: Oxyethylene unit
PO: Oxypropylene unit
BO: Oxytetramethylene unit
HA: Hydrogen atom
MG: Methyl group
EG: Ethyl group
IPG: Isopropyl group
IPNG: Isopentyl group
IBG: Isobutyl group
tBG: t-butyl group
AG: Acetyl group
BG: Butyl group Part 2

TEST EXAMPLE 1

Preparation of Processing Agent (P-1)

Processing agent (P-1) of Test Example 1 for synthetic fibers was prepared by uniformly mixing together 75 parts of lubricant (B-1) described below, 7 parts of hydroxy compound (A-1) shown in Table 1 as functional improvement agent, 10 parts of another functional improvement agent (C-1) described below, 1 part of still another functional improvement agent (E-1) described below and 7 parts of emulsifier (D-1) described below.

Lubricant (B-1): Mixture at weight ratio of 11/14/29/46 of dodecyl dodecanate, ester of α-butyl-ω-hydroxy (polyoxyethylene) (n=3) and dodecanoic acid, polyether monool with number average molecular weight of 3000 obtained by random addition of ethylene oxide and propylene oxide at weight ratio of 50/50 to butyl alcohol, and polyether monool with number average molecular weight of 1000 obtained by block addition of ethylene oxide and propylene oxide at weight ratio of 40/60 to butyl alcohol.

Functional improvement agent (C-1): Mixture at weight ratio 50/50 of potassium octadecenate and potassium decanesulfonate.

Functional improvement agent (E-1): Octyl diphenyl phosphite (antioxidant).

Emulsifier (D-1): Glycerol monolaurate.

TEST EXAMPLES 2-23 AND COMPARISON EXAMPLES 1-5

Preparation of Processing Agents (P-2)—(P-23) and (R-1)-(R-5)

Processing agents (P-2)-(P-23) and (R-1)-(R-5) of Test Examples 2-23 and Comparison Examples 1-5 for synthetic fibers were prepared similarly as processing agent (P-1) described above.

Details of these processing agents are summarized in Table 3.

TABLE 3

| | | Functional improvement agents | | | | | | | |
|---|---|---|---|---|---|---|---|---|---|
| | | Lubricant | | Hydroxy compound | | Others | | Emulsifier | |
| | Kind | Kind | Ratio | Kind | Ratio | Kind | Ratio | Kind | Ratio |
| Test Examples | | | | | | | | | |
| 1 | P-1 | B-1 | 75 | A-1 | 7 | C-1 | 10 | D-1 | 7 |
| | | | | | | E-1 | 1 | | |
| 2 | P-2 | B-1 | 65 | A-2 | 12 | C-2 | 9 | D-2 | 14 |
| 3 | P-3 | B-1 | 55 | A-3 | 18 | C-1 | 9 | D-3 | 18 |
| 4 | P-4 | B-2 | 65 | A-4 | 7 | C-1 | 13 | D-2 | 14 |
| | | | | | | E-2 | 1 | | |
| 5 | P-5 | B-2 | 55 | A-5 | 12 | C-2 | 15 | D-3 | 18 |
| 6 | P-6 | B-3 | 75 | A-6 | 7 | C-1 | 11 | D-1 | 7 |
| 7 | P-7 | B-3 | 65 | A-7 | 7 | C-2 | 11 | D-3 | 16 |
| | | | | | | E-3 | 1 | | |
| 8 | P-8 | B-4 | 65 | A-8 | 12 | C-3 | 7 | D-3 | 16 |
| 9 | P-9 | B-1 | 65 | A-9 | 18 | C-1 | 3 | D-2 | 14 |
| 10 | P-10 | B-2 | 65 | A-10 | 7 | C-2 | 11 | D-3 | 16 |
| | | | | | | E-3 | 1 | | |
| 11 | P-11 | B-1 | 65 | A-11 | 12 | C-4 | 9 | D-2 | 14 |
| 12 | P-12 | B-2 | 80 | A-12 | 3 | C-5 | 5 | D-2 | 12 |
| 13 | P-13 | B-1 | 54 | A-13 | 26 | C-6 | 5 | D-3 | 15 |
| 14 | P-14 | B-1 | 65 | A-14 | 7 | C-1 | 12 | D-3 | 16 |
| 15 | P-15 | B-1 | 75 | A-15 | 7 | C-1 | 11 | D-1 | 7 |
| 16 | P-16 | B-2 | 65 | A-16 | 12 | C-2 | 8 | D-2 | 14 |
| | | | | | | E-1 | 1 | | |
| 17 | P-17 | B-2 | 55 | A-17 | 18 | C-1 | 9 | D-3 | 18 |
| 18 | P-18 | B-3 | 65 | A-18 | 12 | C-1 | 9 | D-2 | 14 |
| 19 | P-19 | B-4 | 65 | A-18 | 12 | C-2 | 8 | D-2 | 14 |
| | | | | | | E-3 | 1 | | |
| 20 | P-20 | B-1 | 65 | A-19 | 12 | C-1 | 9 | D-2 | 14 |
| 21 | P-21 | B-2 | 80 | A-20 | 2 | C-5 | 6 | D-1 | 12 |
| 22 | P-22 | B-5 | 54 | A-21 | 28 | C-6 | 3 | D-3 | 15 |
| 23 | P-23 | B-2 | 65 | A-22 | 10 | C-5 | 11 | D-2 | 14 |
| Comparison Examples | | | | | | | | | |
| 1 | R-1 | B-2 | 65 | a-1 | 18 | C-3 | 3 | D-2 | 14 |
| 2 | R-2 | B-2 | 65 | a-2 | 18 | C-3 | 3 | D-2 | 14 |
| 3 | R-3 | B-2 | 65 | a-3 | 18 | C-3 | 3 | D-2 | 14 |
| 4 | R-4 | B-2 | 70 | A-14 | 0.5 | C-3 | 14.5 | D-2 | 15 |
| 5 | R-5 | B-2 | 54 | A-14 | 33 | C-3 | 7 | D-2 | 6 |

In Table 3:
Ratio: Weight part;
B-1: Mixture of dodecyl dodecanate, ester of α-butyl-ω-hydroxy (polyoxyethylene) (n = 3) and dodecanoic acid, polyether monool with number average molecular weight of 3000 obtained by random addition of ethylene oxide and propylene oxide at weight ratio of 50/50 to butyl alcohol, and polyether monool with number average molecular weight of 1000 obtained by block addition of ethylene oxide and propylene oxide at weight ratio of 40/60 to butyl alcohol at weight ratio of 11/14/29/46;
B-2: Mixture of lauryl octanate, polyether monool with number average molecular weight of 3000 obtained by random addition of ethylene oxide and propylene oxide at weight ratio of 65/35 to butyl alcohol, and polyether monool with number average molecular weight of 2500 obtained by random addition of ethylene oxide and propylene oxide at weight ratio of 40/60 to butyl alcohol at weight ratio of 30/20/50;

TABLE 3-continued

B-3: Mixture of polyether monool with number average molecular weight of 10000 obtained by random addition of ethylene oxide and propylene oxide at weight ratio of 50/50 to butyl alcohol, polyether monool with number average molecular weight of 2500 obtained by random addition of ethylene oxide and propylene oxide at weight ratio of 50/50 to lauryl alcohol, and polyether monool with number average molecular weight of 1000 obtained by block addition of ethylene oxide and propylene oxide at weight ratio of 45/55 to octyl alcohol at weight ratio of 30/50/20;
B-4: Mixture of lauryl octanate and mineral oil with viscosity $1.3 \times 10^{-5}$ $m^2/s$ at 30° C. at weight ratio of 67/33;
B-5: Mixture of mineral oil with viscosity $3.0 \times 10^{-5}$ $m^2/s$ at 30° C., lauryl acid ester of α-butyl-ω-hydroxy (polyoxyethylene) (n = 8), and polyether monool with number average molecular weight of 1800 obtained by block addition of ethylene oxide and propylene oxide to butyl alcohol at weight ratio of 24/16/60;
A-1-A-22, a-1-a-3: Hydroxy compounds prepared in Part 1 and described in Tables 1 and 2.
D-1: Glycerol monolaurate;
D-2: α-dodecyl-ω-hydroxy (polyoxyethylene) (n = 7);
D-3: Mixture of castor oil with addition of 20 moles of ethylene oxide and diester of 1 mole of polyethylene glycol with average molecular weight of 600 and 2 moles of lauric acid at weight ratio of 80/20;
C-1: Mixture of potassium octadecenate and potassium decane sulfonate at weight ratio of 50/50;
C-2: Mixture of butyl diethanol amine laurate, sodium octadecyl benzene sulfonate, and potassium phosphoric acid ester of α-lauryl-ω-hydroxy (trioxyethylene) at weight ratio of 50/25/25;
C-3: Mixture of tributyl methyl ammonium diethylphosphate and sodium octadecyl benzene sulfonate at weight ratio of 60/40;
C-4: Mixture of dimethyl lauryl amine oxide and tributylmethyl ammonium diethyl phosphate at weight ratio of 50/50;
C-5: Mixture of tributylmethyl ammonium diethyl phosphate and lauryl trimethyl ammonium ethylsulfate at weight ratio of 60/40;
C-6: Mixture of decyl dimethyl ammonio acetate and N,N-bis(2-carboxyethyl)-octylamine at weight ratio of 50/50;
E-1: Octyl diphenyl phosphite (antioxidant);
E-2: 3,5-di-t-butyl-4-hydroxy-toluene (antioxidant);
E-3: dilauryl-3,3'-thiopropionate (antioxidant).

Part 3 (Attachment of Processing Agents to Synthetic Fibers, False Twisting and Evaluation)

Each of the processing agents prepared in Part 2 was diluted with water to prepare a 10% aqueous solution. After polyethylene terephthalate chips with intrinsic viscosity of 0.64 and containing titanium oxide by 0.2% were dried by a known method, they were spun at 295° C. by using an extruder. The 10% aqueous solution thus prepared was applied onto the yarns extruded out of the nozzle to be cooled and solidified by a guide oiling method using a measuring pump such that the attached amount of the processing agent became as shown in Table 4. Thereafter, the yarns were collected by means of a guide and wound up at the rate of 3000 m/minute without any drawing by a mechanical means to obtain partially oriented 56 decitex-144 filament yarns as wound cakes of 10 kg.

False Twisting

The cakes thus obtained as described above were subjected to a false twisting process under the conditions described below by using a false twister of the contact heater type (product name of SDS1200 produced by Teijinseiki Co., Ltd.):

| | |
|---|---|
| Fabrication speeds: | 800 m/minute and 1200 m/minute; |
| Draw ratio: | 1.652; |
| Twisting system: | Three-axis disk friction method (with one guide disk on the inlet side, one guide disk on the outlet side and four hard polyurethane disks); |

-continued

| | |
|---|---|
| Heater on twisting side: | Length of 2.5 m with surface temperature of 210° C.; |
| Heater on untwisting side; | None; |
| Target number of twisting; | 3300 T/m. |

The false twisting process was carried out under the conditions given above by a continuous operation of 25 days.

Evaluation of Fluffs

In the aforementioned false twisting process, the number of fluffs per hour was measured by means of a fly counter (produce name of DT-105 produced by Toray Engineering Co., Ltd.) before the false twisted yarns were wound up and evaluated according to the standards as described below:

A: The measured number of fluffs was zero;

A-B: The measured number of fluffs was less than 1 (exclusive of zero);

B: The measured number of fluffs was 1-2;

C: The measured number of fluffs was 3-9;

D: The measured number of fluffs was 10 or greater.

The results of the measurement are shown in Table 4.

Evaluation of Yarn Breaking

The number of occurrences of yarn breaking during the 25 days of operation in the false twisting process described above was converted into the number per day and such converted numbers were evaluated according to the standards as described below:

A: The number of occurrence was zero;

A-B: The number of occurrence was less than 0.5 (exclusive of zero);

B: The number of occurrence was 0.5 or greater and less than 1;

C: The number of occurrence was 1 or greater and less than 5;

D: The number of occurrence was 5 or greater.

The results are shown in Table 4.

Dyeing Property

A fabric with diameter of 70 mm and length of 1.2 m was produced from the false-twisted yarns on which fluffs were measured as above by using a knitting machine for tubular fabric. The fabric thus produced was dyed by a high temperature and high pressure dyeing machine by using disperse dyes (product name of Kayalon Polyester Blue-EBL-E produced by Nippon Kayaku Co. Ltd.). The dyed fabrics were washed with water, subjected to a reduction clearing process and dried according to a known routine and were thereafter set on an iron cylinder with diameter 70 mm and length 1 m. An inspection process for visually counting the number of points of densely dyed potion on the fabric surface was repeated five times and the evaluation results thus obtained were converted into the number of points per sheet of fabric. The evaluation was carried out according to the following standards:

A: There was no densely dyed portion;

A-B: There was 1 point of densely dyed portion;

B: There were 2 points of densely dyed portion;

C: There were 3-6 points of densely dyed portion;

D: There were 7 or more points of densely dyed portion.

The results are shown in Table 4.

This invention, as described above, has the favorable effects of sufficiently preventing the occurrence of fluffs, yarn breaking and dyeing specks even when synthetic fibers of new kinds such as low denier synthetic fibers, high multifilament synthetic fibers and modified cross-section synthetic fibers are being produced at a fast rate.

TABLE 4

| | Processing agent | | | | | | | |
|---|---|---|---|---|---|---|---|---|
| | | Rate of | 800 m/minute | | | 1200 m/minute | | |
| | Kind | attachment (%) | Fluffs | Yarn breaking | Dyeing property | Fluffs | Yarn breaking | Dyeing property |
| Test Example | | | | | | | | |
| 24 | P-1 | 0.4 | A | A | A | A | A | A |
| 25 | P-1 | 0.8 | A | A | A | A | A | A |
| 26 | P-2 | 0.6 | A | A | A | A | A | A |
| 27 | P-2 | 0.3 | A | A | A | A | A | A |
| 28 | P-3 | 0.6 | A | A | A | A | A | A |
| 29 | P-3 | 0.8 | A | A | A | A | A | A |
| 30 | P-4 | 0.4 | A | A | A | A | A | A |
| 31 | P-5 | 0.5 | A | A | A | A | A | A |
| 32 | P-6 | 0.4 | A | A | A | A | A | A |
| 33 | P-7 | 0.4 | A | A | A | A | A | A |
| 34 | P-8 | 0.4 | A | A | A | A | A | A |
| 35 | P-9 | 0.4 | A | A | A | A-B | A | A |
| 36 | P-10 | 0.4 | A | A | A | A | A-B | A |
| 37 | P-11 | 0.4 | A | A-B | A | A | A-B | A |
| 38 | P-12 | 0.4 | A-B | A | A | A-B | A-B | A-B |
| 39 | P-13 | 0.4 | A | A-B | A | A-B | A-B | A-B |
| 40 | P-14 | 0.5 | A-B | A | A | A-B | A-B | A-B |
| 41 | P-15 | 0.4 | A-B | A-B | A | A | A | A |
| 42 | P-16 | 0.4 | A | A | A | A-B | A | A |
| 43 | P-17 | 0.4 | A | A | A | A-B | A | A |
| 44 | P-18 | 0.5 | A | A | A | A-B | A | A |
| 45 | P-19 | 0.6 | A | A | A | A | A | A-B |
| 46 | P-20 | 0.4 | A-B | A-B | B | B | A-B | B |
| 47 | P-21 | 0.4 | A-B | B | A-B | A-B | B | B |
| 48 | P-22 | 0.4 | A-B | B | A-B | B | B | A-B |
| 49 | P-23 | 0.4 | A-B | B | A-B | B | B | A-B |
| Comparison Example | | | | | | | | |
| 6 | R-1 | 0.4 | D | D | D | C | D | C |
| 7 | R-2 | 0.4 | C | C | C | D | D | D |
| 8 | R-3 | 0.4 | C | D | C | D | D | C |
| 9 | R-4 | 0.4 | C | C | D | D | D | D |
| 10 | R-5 | 0.4 | C | C | D | D | D | D |

What is claimed is:

1. A processing agent for synthetic fibers, said processing agent consists of 50-90 weight % of a lubricant, 1-30 weight % of a functional improvement agent and 2-30 weight % of an emulsifier, wherein said lubricant is selected from the group consisting of polyether compounds with average molecular weight of 700-10000, aliphatic ester compounds with 17-60 carbon atoms and mineral oils having a viscosity of $1\times10^{-6}$-$5\times10^{-5}$ $m^2/s$ at 30°C, said functional improvement agent is shown by Formula 2, wherein Formula 2 is:

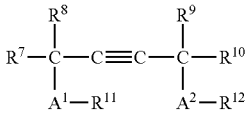

where $R^7$, $R^8$, $R^9$ and $R^{10}$ are each hydrogen atom or aliphatic hydrocarbon group with 1-6 carbon atoms, two or less thereof being hydrogen atom at the same time, the total number of carbon atoms in $R^7$-$R^{10}$ in Formula 2 being 2-14; $R^{11}$ and $R^{12}$ are each hydrogen atom; and $A^1$ and $A^2$ are each residual group obtainable by removing hydrogen atoms from all hydroxyl groups of (poly)alkyleneglycol having (poly)oxyalkylene group formed with a total of 1-30 oxyalkylene units with 2-4 carbon atoms.

2. The processing agent of claim 1 wherein said functional improvement agent is present in a range from 3-25 weight %.

* * * * *